US006164815A

United States Patent [19]

Degonda

[11] Patent Number: 6,164,815

[45] Date of Patent: Dec. 26, 2000

[54] MODULAR JEWELERY ITEM, PARTICULARLY A RING, EARRING, PENDANT OR TIMEPIECE SUCH AS A WATCH

[76] Inventor: Richard Anton Degonda, Oberer Rüweg 1, CH-8803 Ruechlikon, Switzerland

[21] Appl. No.: 09/068,170

[22] PCT Filed: Nov. 5, 1996

[86] PCT No.: PCT/CH96/00389

§ 371 Date: May 29, 1998

§ 102(e) Date: May 29, 1998

[87] PCT Pub. No.: WO97/16993

PCT Pub. Date: May 15, 1997

[30] Foreign Application Priority Data

Nov. 6, 1995 [FR] France ..... 95 13423

[51] Int. Cl.[7] ..... G04B 37/00; G04B 37/12; A44C 13/00; A44C 25/00

[52] U.S. Cl. ..... 368/278; 368/279; 368/281; 368/309; 63/1.13; 63/40

[58] Field of Search ..... 368/10, 69, 88, 368/223, 276, 278, 285, 309, 279, 281, 301, 299–300; 63/1.11, 1.13, 40, 41

[56] References Cited

U.S. PATENT DOCUMENTS

| | | | |
|---|---|---|---|
| 3,695,031 | 10/1972 | Loeb | 58/88 |
| 4,586,827 | 5/1986 | Hirsch et al. | 368/282 |
| 5,008,864 | 4/1991 | Yoshitake | 368/10 |

FOREIGN PATENT DOCUMENTS

| | | |
|---|---|---|
| 0 570 990 A1 | 11/1993 | European Pat. Off. . |
| 27 56 336 | 6/1978 | Germany . |
| 41 39 857 A1 | 6/1993 | Germany . |
| 94 08 851 | 9/1994 | Germany . |

*Primary Examiner*—Vit Miska
*Attorney, Agent, or Firm*—Davis and Bujold

[57] ABSTRACT

A modular jewelry item, particularly a ring, an earring, a pendant, or a timepiece such as a watch, consisting of at least one hollow portion and one central portion complementary in shape to the hollow portion, said central portion being detachable from the hollow portion.

20 Claims, 2 Drawing Sheets

MODULAR JEWELERY ITEM, PARTICULARLY A RING, EARRING, PENDANT OR TIMEPIECE SUCH AS A WATCH

BACKGROUND OF THE INVENTION

The present invention concerns a modular jewelry item, particularly a ring, an earring, a pendant, or a timepiece such as a watch, consisting of at least one hollow portion and one central portion complementary in shape to the hollow portion, said central portion being detachable from the hollow portion.

Similar jewelry items already exist, such as watches with telecommunications capabilities or other such functions not found on conventional watches. All of these watches incorporate a digital data display device. However, the display means and the extra features usually are not in use all the time. Furthermore, the display is often unattractive and suitable only for utilitarian watches. It is especially unsuitable for fashion watches and/or analog watches.

SUMMARY OF THE INVENTION

A goal of the present invention is to overcome these obstacles by proposing a jewelry item such as a ring, an earring, a pendant, or a watch having a conventional appearance, but also offering various specialized features, designed so that these features can be customized by the wearer.

This goal is achieved by a jewelry item such as that described in the preamble, characterized in that the hollow portion is reversible and comprises at least one so-called functional surface which gives the user access to at least one specialized function supplemental to the original purpose of the jewelry item.

According to a preferred embodiment, one of the surfaces of the hollow portion is a so-called decorative surface, lending an aesthetic appearance to the item, while the other surface is the so-called functional surface.

According to a first embodiment, the central element comprises at least one decorative portion.

According to a second embodiment, the central element comprises a casing containing a timepiece movement driving at least one watch hand.

The functional surface of the hollow portion preferably comprises at least one digital data display device.

According to one advantageous embodiment, the functional surface of the hollow portion may include a display screen which covers the central element when the hollow portion is in the functional position. It may also include at least one solar cell.

The hollow portion advantageously incorporates means for mechanically attaching it to the central element.

According to the various embodiments, the hollow portion may include means for electrical, optoelectronic, or radioelectric connection to said central element.

The jewelry item according to the present invention preferably has at least one data storage device for recording information.

According to one preferred embodiment, the hollow portion comprises at least one sensor which measures some physical or chemical quantity outside the watch.

Said hollow portion may also include means for connecting an exterior sensor to a display device on the jewelry.

According to one preferred embodiment, the hollow portion comprises means for transmitting and/or receiving signals.

The hollow portion may also include at least one electrical energy reserve and/or a programmable microprocessor.

According to another particular embodiment, said hollow portion may be slidably mounted on the central element.

BRIEF DESCRIPTION OF THE DRAWINGS

The present invention will be better understood with reference to the following description of various embodiments of the jewelry item of the invention, in conjunction with the attached drawings, in which.

DESCRIPTION OF THE PREFERRED EMBODIMENT

Figure 1:
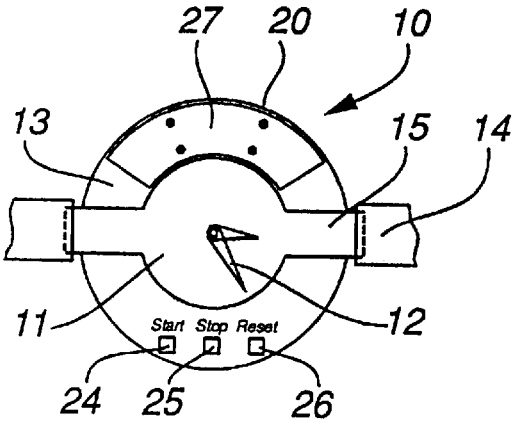
FIG. 1 is a top view of a first embodiment of a modular jewelry item in accordance with the invention, shown in the form of a wristwatch.
Figure 2:
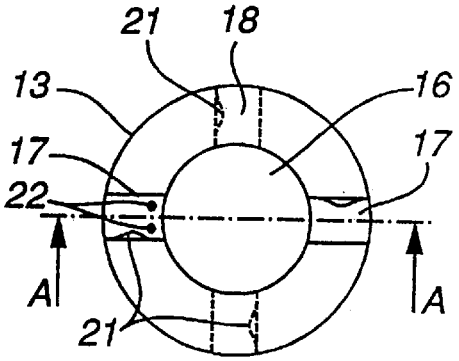
FIG. 2 is a surface view of the hollow portion of the watch of FIG. 1.
Figure 3:
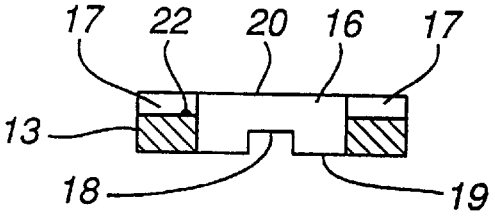
FIG. 3 is a transverse cross-section taken along line A—A of the portion of FIG. 2.

The modular jewelry item of the present invention shown in FIGS. 1 through 9 is a timepiece 10 such as a wristwatch essentially comprising a casing 11 forming the central element and containing the movement driving watch hands 12, a reversible hollow portion 13, and a watchband 14. Casing 11 is generally circular and comprises two extensions 15 for attaching it to the watchband. Hollow portion 13, as shown in FIGS. 2 and 3, comprises an opening 16 shaped to adapt to the watch casing, and two notches 17, 18 on each surface. These notches accommodate extensions 15 when the hollow portion is connected to the central portion, that is, to casing 11.

One surface of reversible element 13 is a decorative surface, giving the watch an aesthetic appearance. This surface is called the decorative surface 19 of the hollow portion. The other surface incorporates the means for accessing the specialized features of the watch. This surface is called the functional surface 20 of the hollow portion.

In the embodiment shown, notches 17, 18 on one surface are offset by 90° from the notches on the other surface. This arrangement allows the hollow portion to remain thin without becoming too fragile.

Hollow portion 13 also has four spring plates 21 made of electrically conductive material. These spring plates establish electrical contact between the elements inside the hollow portion and the elements inside the casing. They also form a detachable connection between the hollow portion and the casing. Obviously, there are other ways to form the electrical connection and mechanical coupling. In this instance, the electrical contact may depend upon two cylindrical contacts 22 inside one of the notches on the hollow portion and positioned opposite two similar contacts which are below one of the extensions 15 of casing 11.

In all the variations shown in FIGS. 1 through 9, hollow portion 13 has one decorative surface 19 and one functional surface 20. The functions accessed using the hollow portion can vary widely. They can be classified in various categories depending upon the different elements which they employ.

FIGS. 1 through 5 show some examples of functions which utilize only the hollow portion, the casing and the movement, and do not depend upon any element outside the jewelry item.

Specifically, in the embodiment shown in FIG. 1, functional surface 20 of the hollow portion functions as a chronometer. The chronometer has an on button 24, an off button 25, and a zero-reset button 26. It also has a digital display 27 showing time elapsed. The chronometer is controlled by the same time basis that drives the watch hands. This embodiment illustrates how information is transmitted from casing 11 to hollow portion 13, using the two cylindrical contacts 22. The digital readout showing time elapsed is easier to read and more precise than an analog display. Thus, using this type of hollow portion improves the precision of the chronometer, while the watch still conserves an esthetic appearance. When the wearer no longer needs the watch to function as a chronometer, he or she reverses the hollow portion so that decorative surface 19 is visible. In this configuration, the watch retains its conventional appearance.

Figure 4:
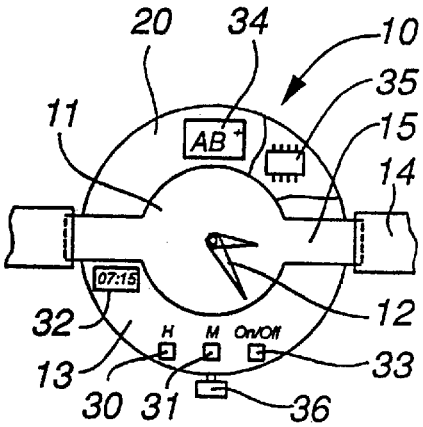
FIGS. 4 through 7 are schematic representations of various embodiments of the watch of FIG. 1, each performing certain functions accessed when a different hollow portion is used.

The variation shown in FIG. 4 provides access to two distinct functions. One of these functions is to sound an alarm or a signal. The functional surface 20 of the watch has two buttons 30, 31 for setting the alarm, determining the hour and the minute, respectively. This information is displayed on a display means 32, so the setting can be verified. A third button 33 activates or deactivates the alarm. If it is activated, the alarm signal is emitted when the watch hands reach the position that corresponds to the time selected. The alarm may be an audio or a visual signal, or it may cause the timepiece to vibrate in order to alert the wearer. This embodiment requires that data be introduced into the watch movement using hollow portion 13. The second function offered by this embodiment of hollow portion 13 is a pure display function. The hollow portion comprises a display means 34 and a means 35 for storing prerecorded information. This information might include personal and/or medical data about the wearer, such as, for example, date of birth, blood type, or information concerning specific medical conditions or allergies to medication. These facts can be viewed in succession, as device 34 displays one piece of information with each push of watch button 36. Once the data has been stored, no further communication with either the watch movement or any external device is required to display it. The display depends upon only hollow portion 13 and periodically, upon an energy source located inside case 11.

Figure 5:
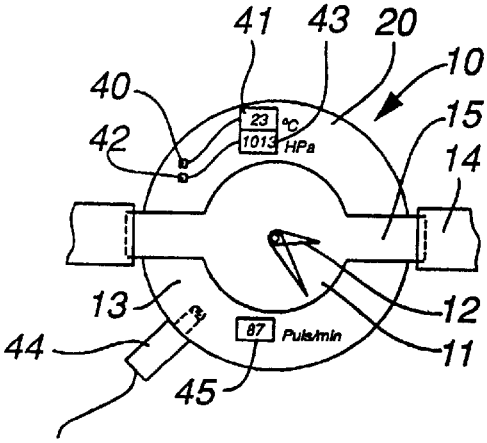

The variation in FIG. 5 shows functions associating a sensor with a display means. Such sensors may be incorporated within the hollow portion for measuring physical and/or chemical quantities in the environment where the watch is functioning. This is the case when a temperature sensor 40 is associated with a display 41, or a pressure sensor 42 is associated with a display 43. The sensor could also be remote from the hollow portion, connected to the watch by means of an electrical connector 44. This is the case with a cardiac monitor (not shown) associated with a pulse display 45. In this instance, the sensor may be incorporated into the watchband 14 or attached around the chest of the wearer. This embodiment requires that information extrinsic to the watch be transmitted to the hollow portion, which processes and displays the data. It is also possible to use one of the watch hands, for example, the second indicator, to display some of the data transmitted.

Figure 6:
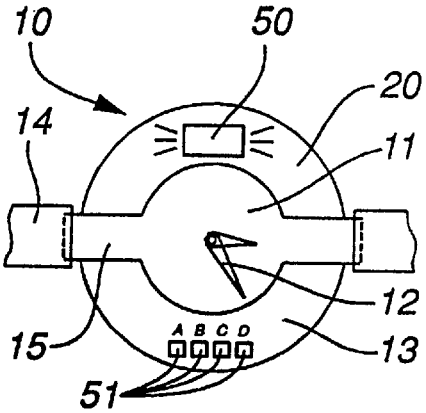

The variation shown in FIG. 6 has two distinct functions. One is to emit a signal showing the position of the wearer, using an emitter 50. This signal is used for remote surveillance. It is also useful in searching for people who are lost, for example, at sea or after an avalanche. It may be connected to a positioning device such as the device known by the abbreviation GPS (Global Positioning System). The second function shown in this drawing is to emit an identification code. This code is generated using four buttons 51 located on the hollow portion; it may open an access door to a location under surveillance. This embodiment illustrates how the watch emits a signal to an exterior detector. Signals of this type are generated by placing an antenna in the hollow portion. The antenna may also consist of the hollow portion itself, or it may form a part of the surface of this hollow portion.

The antenna consists of a coil of metal wires rolled up inside the hollow portion. This embodiment is interesting because the antenna may be relatively large, and therefore highly sensitive, while remaining completely invisible. In addition, if a different type of signal is to be detected, the antenna is easily changed by merely switching the hollow portion.

Figure 7:
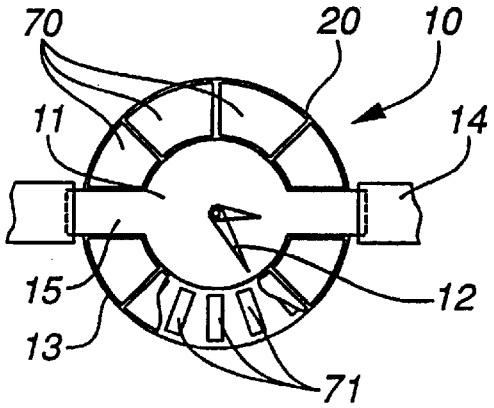

FIG. 7 shows a variation consisting of a hollow portion 13 with its functional surface 20 covered with solar cells 70. This hollow portion also forms a housing for condensers 71 or electrical batteries. When the surface with the solar cells 70 is at the top, the light trapped by the cells is converted into electrical energy and charges the condensers. When the hollow portion is in the decorative position, the watch movement depends upon the energy stored in the condensers of the hollow portion. Electrical energy could also be furnished by thermal cells using body heat from the wearer and transforming it into electricity. The condensers or batteries can also be charged by a transformer connected to a conventional supply network.

Figure 8A:
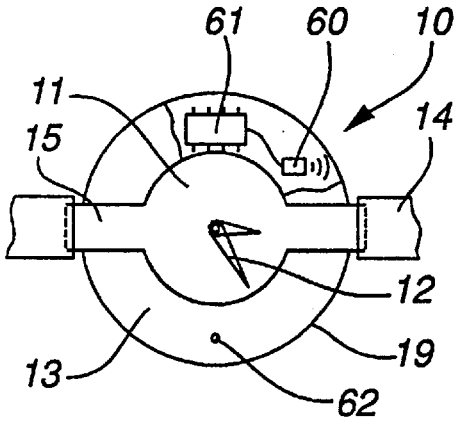
FIG. 8*a* is a partial cross-section of another variation of the watch of FIG. 1 equipped with a hollow portion having a single opening.
Figure 8B:
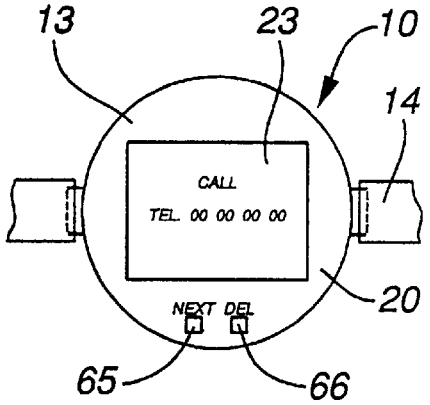
FIG. 8*b* is a view of the watch shown in FIG. 8*a* when the hollow portion has been reversed from the position shown in FIG. 8*a;*
Figure 9:
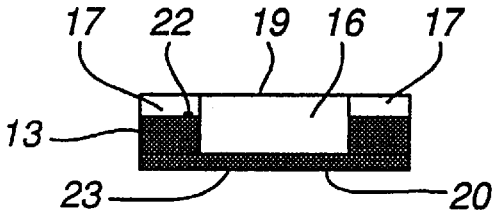
FIG. 9 is a cross-section of the hollow portion of FIGS. 8*a* and 8*b.

The variation shown in FIGS. 8*a,* 8*b* and 9 is equipped with a hollow portion 13 in which opening 16 forms a single hole and functional surface 20 has a digital display 23 designed to cover the unit of watch case 11. When the hollow portion is positioned so that decorative surface 19 is visible to the wearer, the watch has a conventional appearance. Casing 11 is housed inside opening 16 and screen 23 is located beneath the watch. Thus, the screen is completely invisible. When the hollow portion is positioned so that the functional surface is visible, screen 23 covers watch casing 11. Watch hands 12 are thus no longer visible, but various data is visible on the screen. The hollow portion also has, beneath the decorative surface, an electromagnetic signal receptor 60 and a data storage device 61. It further comprises an audio or visual alarm 62 and a display screen 23 on functional surface 20. Signal receptor 60 comprises an electromagnetic wave receptor antenna. These waves may consist of radio waves generated by a suitable emission device, or light waves generated by an emission device associated with a computer. The signals captured by the receptor are decoded to extract the data they contain. This data is recorded in storage device 61. If alarm 62 is a visual alarm, when a message is stored the alarm alerts the wearer that a message has been received. The alarm is designed to be visible to the wearer when hollow portion 13 is in the decorative position, and it is as discreet as possible so it does not detract from the appearance of the watch. For example, it may consist of a luminous diode covered by a translucent crystal. If alarm 62 is an auditory alarm, an auditory signal sounds when a message has been recorded. When the wearer wishes to view the message, he or she places hollow portion 13 in the functional position. In this position, screen 23 completely covers the watch and the message is displayed. Pushing a button 65 provided near this screen displays the next message if there are several stored messages. Another button 66 will erase the displayed message, freeing space in data storage device 61. This embodiment has a fairly large display surface. It illustrates how the watch can be used to receive data transmitted from external sources to the hollow portion.

Figure 10:
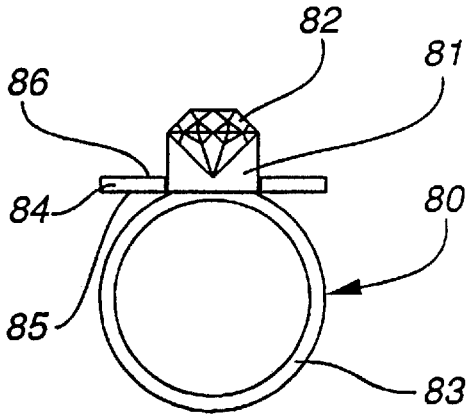
* and FIG. 10 shows a variation of the modular jewelry item of the present invention in the form of a ring.

FIG. 10 shows a variation of the modular jewelry item of the invention in the form of a ring. Ring 80 has a shank 81 constituting the central element, with a stone 82 set in it, said shank being integral with a toric ring 83 to be placed on the finger of the wearer. A hollow portion 84 in the form of a reversible disc is placed around shank 81; it has one functional surface 85 and one decorative surface 86. When the decorative surface is visible to the wearer, the ring has a conventional appearance. When the functional surface is visible, various functions become accessible using hollow portion 84.

The present invention is not limited to the embodiments described herein, but extends to any modification or variation obvious to one skilled in the art. More specifically, the central element may be an oval, a rectangle, a polygon, or any other shape, provided the hollow portion is complementary so it can be placed around the casing or the shank in two different positions allowing its two surfaces 19, 20 to be alternately visible.

The hollow portion could also be incorporated in the casing of the timepiece in such a way that it remains invisible when not in use. This can be done by placing the element beneath the watch casing or even inside it. Access means are then provided so the hollow portion can be moved into the functional position.

The functions described with reference to the drawings have been divided into different types. It is apparent that a single jewelry item may incorporate various functions. The only restrictions are the restrictions imposed by the surface or space available for the hollow portion. Since the jewelry item is modular, various functions may be integrated within the hollow portion at the user's discretion. It is also possible to provide several hollow portions, each with different functions, and/or different decorative surfaces.

Additionally, is possible to separate the hollow portion into a decorative piece and a functional piece, with the decorative piece comprising one decorative surface and one intermediate surface, while the functional piece comprises one functional surface and one intermediate surface, with both intermediate surfaces being in continuous contact with each other. Providing a certain number of decorative pieces and functional pieces makes it possible to form any combination of decorative and functional pieces, and therefore allows the user to modify the functions of the jewelry item at will.

It is possible to incorporate other functions into the jewelry item besides those described above. In addition, different devices can be used to connect the hollow portion and the watch movement, as long as they are capable of transmitting energy and/or data. Such connection devices might consist of optical, optoelectronic and/or electromagnetic devices. The jewelry item could then be connected to a data transmission network.

The hollow portion might take the form of a ring element attached to the casing or the shank with a screw, a spring device, or any other suitable means.

Finally, the hollow portion might be adapted to a watchband, a pocket watch, a pendant watch, any other timepiece, or to a ring or a pendant.

I claim:

1. A modular jewelry item having an esthetic function, the jewelry item comprising:

at least one hollow portion having an opening therein;

a central portion having complementary exterior shape to facilitate engagement with the opening of the hollow portion such that the central portion is attachable and detachable from the hollow portion;

wherein the hollow portion has two opposed surfaces, the hollow portion is reversible such that either of the two opposed surfaces of the hollow portion can be utilized to receive the central portion, and at least a first of the two opposed surfaces is a functional surface (20) which supports means for accessing at least one supplemental function of the jewelry item, other than the esthetic function of the jewelry item.

2. The jewelry item according to claim 1, wherein a second of the two opposed surfaces of the hollow portion (13, 84) is a decorative surface (19) which provides the jewelry item a desired esthetic appearance.

3. The jewelry item according to claim 1, wherein a second of the two opposed surfaces of the hollow portion (13, 84) supports at least one decorative element and the hollow portion has electrical contacts which communicate with mating contacts of the central portion to supply electrical power to the at least one supplemental function of the hollow portion.

4. The jewelry item according to claim 1, wherein the central portion comprises a casing (11) containing a watch movement for a timepiece (10), and the watch movement drives at least one hand (12) of the timepiece (10) to facilitate displaying time by the timepiece (10).

5. The jewelry item according to claim 1, wherein the functional surface (20) of the hollow portion (13, 84) comprises at least one digital data display device (27, 32, 34, 45) for displaying desired indicia of the jewelry item.

6. The jewelry item according to claim 1, wherein the functional surface (20) of the hollow portion (13) comprises at least one display screen (23), the at least one display screen (23) extends across the opening of the functional surface (20), and when the functional surface (20) is utilized to receive the central portion, the at least one display screen (23) covers the central portion.

7. The jewelry item according to claim 1, wherein the functional surface (20) of the hollow portion (13) comprises at least one solar cell (70) for generating electrical power for use by the jewelry item.

8. The jewelry item according to claim 1, wherein the hollow portion (13) has means for mechanically attaching the hollow portion (13) to the central portion.

9. The jewelry item according to claim 1, wherein said hollow portion (13) has means for electrically attaching the hollow portion (13) to the central portion.

10. The jewelry item according to claim 1, wherein said hollow portion (13) has means for optoelectronically attaching the hollow portion (13) to the central portion.

11. The jewelry item according to claim 1, wherein said hollow portion (13) has means for radioelectrically attaching the hollow portion (13) to the central portion.

12. The jewelry item according to claim 6, wherein said hollow portion (13) includes at least one memory storage device (61) for at least one of storing and retrieving data to be displayed by the at least one display screen (23).

13. The jewelry item according to claim 1, wherein said hollow portion (13) has at least one sensor (40, 42) which measures a quantity of one of a physical feature and a chemical feature, external of the jewelry item, to facilitate display of the measured feature by the jewelry item.

14. The jewelry item according to claim 1, wherein said hollow portion (13) comprises a connection mechanism for connecting a sensor, support on an exterior of the jewelry item, to display means supported on the jewelry item to facilitate displaying information sensed by the sensor.

15. The jewelry item according to claim 1, wherein said hollow portion (13) has a signal emission device for emitting a desired signal by the jewelry item.

16. The jewelry item according to claim 1, wherein said hollow portion (13) has a signal receptor device for receiving, via the jewelry item, an emitted signal.

17. The jewelry item according to claim 1, wherein said hollow portion (13) has at least one electrical energy storage device for supplying electrical energy to electrical components of the jewelry item.

18. The jewelry item according to claim 1, wherein said hollow portion (13) has at least one programmable microprocessor for facilitating operation of electrical components of the jewelry item.

19. The jewelry item according to claim 1, wherein the jewelry item is one of a ring, an earring, a pendant, and a timepiece.

20. A modular jewelry item having an esthetic function, the jewelry item comprising:

at least one hollow portion having an opening therein;

a central portion having complementary exterior shape to facilitate engagement with the opening of the hollow portion such that the central portion is releasably attachable and detachable from the hollow portion;

wherein the hollow portion has two opposed surfaces, a first of the two opposed surfaces is a functional surface (20) which supports means for accessing at least one supplemental function of the jewelry item, other than the esthetic function of the jewelry item, and a second of the two opposed surfaces of the hollow portion (13, 84) is a decorative surface (19), the hollow portion is reversible such that either of the first and second opposed surfaces of the hollow portion can be utilized for receiving the central portion, and both the first and second opposed surfaces of the hollow portion each have a pair of aligned notches to facilitating receiving a respective extension of the central portion.

* * * * *

UNITED STATES PATENT AND TRADEMARK OFFICE

CERTIFICATE OF CORRECTION

PATENT NO. : 6,164,815
DATED : December 26, 2000
INVENTOR(S) : Richard Anton Degonda It is certified that error appears in the above-identified patent and that said Letters Patent is hereby corrected as shown below:

Title page,
Replace item [76] with:

[76] Inventor: Richard Anton Degonda, Oberer
Rütiweg 1, CH-8803 Rueschlikon
Switzerland Signed and Sealed this Twenty-third Day of October, 2001

*Attest:*

Nicholas P. Godici

NICHOLAS P. GODICI
*Acting Director of the United States Patent and Trademark Office*

*Attesting Officer*